US005269054A

United States Patent [19]

Poteat et al.

[11] Patent Number: 5,269,054

[45] Date of Patent: Dec. 14, 1993

[54] CLIP ATTACHMENT APPARATUS

[75] Inventors: William M. Poteat; Bryan Wilkins, both of Raleigh; Kim L. Poling, Fuquay-Varina; Edward P. Brinson, Raleigh; Thomas E. Whittlesey, Apex, all of N.C.

[73] Assignee: Delaware Capital Formation, Inc., Apex, N.C.

[21] Appl. No.: 884,597

[22] Filed: May 15, 1992

[51] Int. Cl.[5] ..... B23P 19/04; B65B 51/08

[52] U.S. Cl. ..... 29/564.7; 29/243.56; 53/138.4

[58] Field of Search ..... 29/243.56, 243.57, 564.6, 29/564.7, 564.8; 53/138.3, 138.4

[56] References Cited

U.S. PATENT DOCUMENTS

| | | | |
|---|---|---|---|
| 2,682,659 | 7/1954 | Blumensaadt | 29/243.56 |
| 2,971,194 | 2/1961 | Hahn | 29/243.57 |
| 3,543,378 | 12/1970 | Klenz | 29/243.67 |
| 3,777,400 | 12/1973 | Klenz et al. | 206/56 |
| 3,783,583 | 1/1974 | Dobbert | 53/138 |
| 3,795,085 | 3/1974 | Andre et al. | 53/112 |
| 4,001,926 | 1/1977 | Velarde | 29/243.56 |
| 4,004,339 | 1/1977 | Velarde | 29/243.56 |
| 4,109,363 | 8/1978 | Velarde | 29/243.56 |
| 4,218,861 | 8/1980 | Marz | 53/138.4 |
| 4,233,729 | 11/1980 | Koenig | 29/564.8 |
| 4,475,374 | 10/1984 | Sakai et al. | 29/243.56 |
| 4,675,945 | 6/1987 | Evans et al. | 17/33 |
| 4,766,713 | 8/1988 | Evans | 53/138 |
| 4,821,485 | 4/1989 | Evans et al. | 53/138 |
| 4,827,591 | 5/1989 | Arnone | 29/243.56 |
| 4,993,135 | 2/1991 | Seely et al. | 29/243.56 |
| 5,077,955 | 1/1992 | Evans | 53/138.4 |

FOREIGN PATENT DOCUMENTS

| | | | |
|---|---|---|---|
| 544267 | 7/1957 | Canada | 53/138 4 |
| 3333875 | 9/1983 | Fed. Rep. of Germany | . |

*Primary Examiner*—William Briggs

*Attorney, Agent, or Firm*—Allegretti & Witcoff, Ltd.

[57] ABSTRACT

Clip attachment apparatus for attaching a U-shaped metal clip about gathered material includes a frame, a channel supported on the frame for receiving a clip, a punch for driving the clip in the channel against a die, and a pair of pivot gates which are driven by an eccentric cam and follower responsive to independent actuators. The gates are moveable between a closed position wherein the gates form a part of the channel and position the die at the end of the channel, and an open position for inserting casing material into the clip apparatus.

9 Claims, 8 Drawing Sheets

FIG. 4
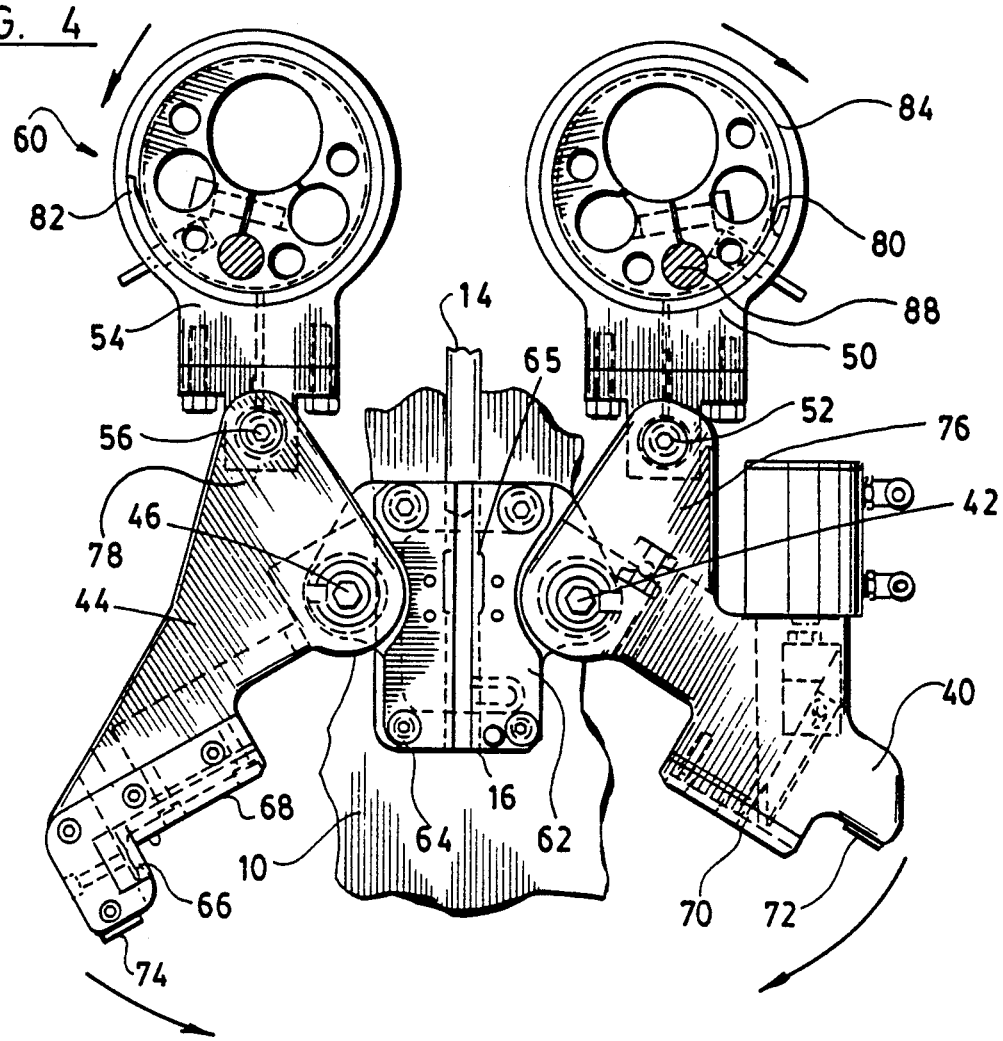
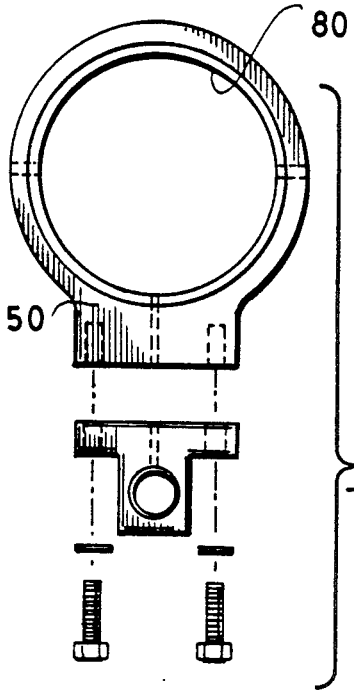
FIG. 7A
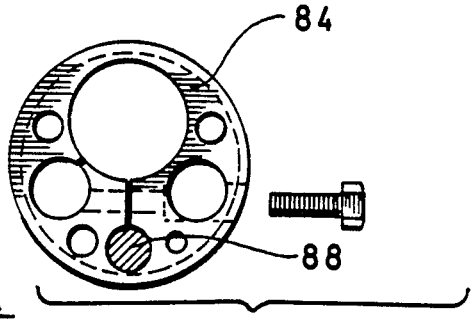
FIG 7

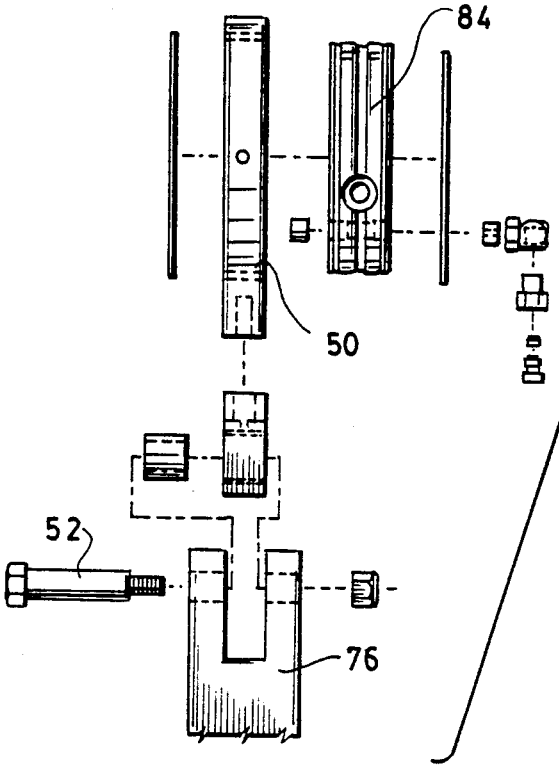
FIG. 7B
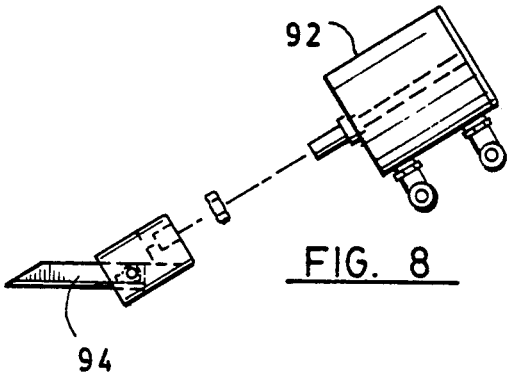
FIG. 8
FIG. 5B
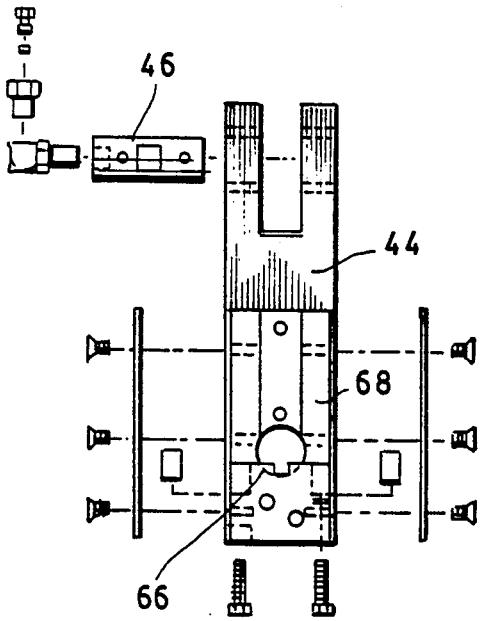
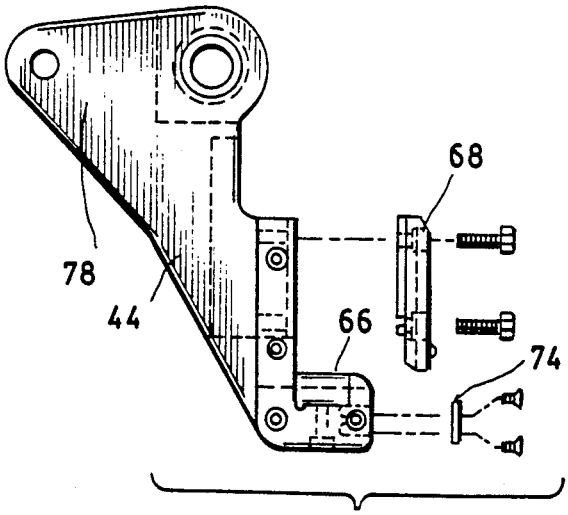
FIG. 5A

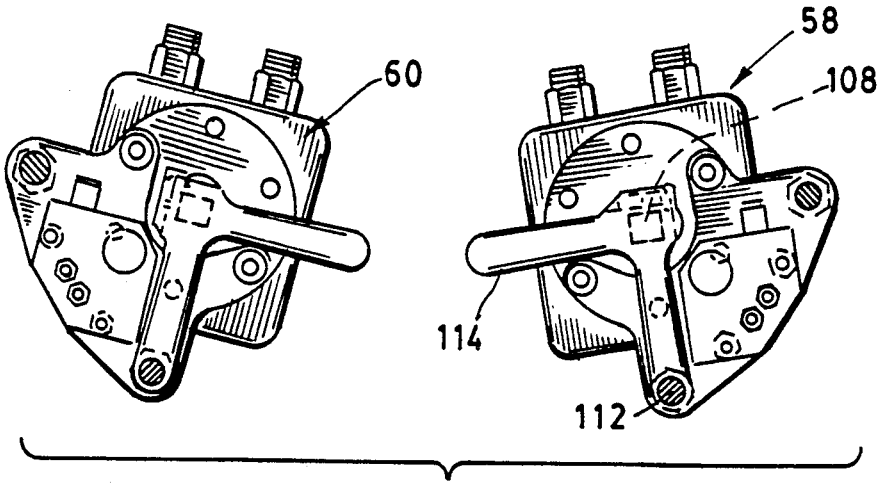
FIG. 10
FIG. 6A
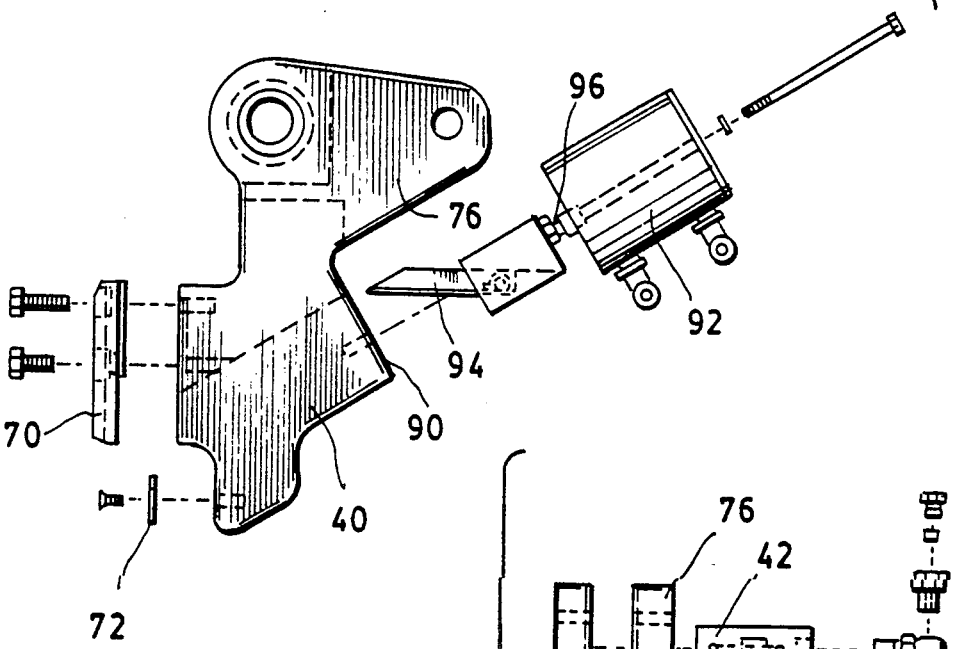
FIG. 6B
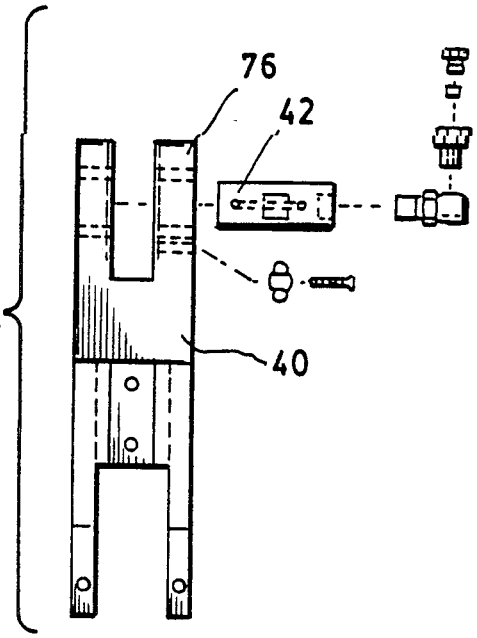

CLIP ATTACHMENT APPARATUS

BACKGROUND OF THE INVENTION

This invention relates to a clip attachment apparatus of the type for attaching U-shaped, metal clips about gathered material.

Various mechanism have been devised for the attachment of U-shaped, metal clips about gathered material. Typically, such mechanisms include, a frame with a clip channel passing vertically through the frame. A window is provided for feeding clips one at a time into the channel so that the clip may be engaged by a reciprocating punch. The punch is operated to drive the clips down the channel and against a die to thereby form the clip about gathered material positioned in the path of the clip. A gate mechanism is typically provided to define a portion of one side of the channel. The gate mechanism is typically pivotally attached to the frame so that the channel may be opened or exposed and then gathered material may be placed in the channel in the path of a descending clip.

Various mechanisms have been suggested for operation of the gate. For example, Klenz in U.S. Pat. No. 3,543,378, entitled Clipping Apparatus, disclosed opposed sliding plates or gate members which are spaced one from the other for insertion of material to be clipped. The gate members then slidably approach one another to compress and form the material. A clip is then driven down a channel defined in one of the gate members for forming about the gathered material. Velarde in U.S. Pat. No. 4,109,363 discloses yet another gate mechanism. In U.S. Pat. No. 4,109,363 a gate is pivotally mounted on the frame and is connected by a linkage to the drive piston which also operates the punch for driving the clip. The linkage ensures that the gate will be rotated to a closed position to form the channel before a clip is driven down the channel against a die. Conversely, when the punch has been retracted from engagement with a clip, the gate is swung open to reveal a throat for receipt of gathered material.

Evans in U.S. Pat. No. 4,675,945 discloses at pivotal or movable gate which pivots out of position to expose a throat for receipt of gathered material. The gate is pivoted by actuation of a separate control cylinder unassociated with the cylinder for driving the punch. Dobbert in U.S. Pat. No. 3,783,583 also discloses a gate mechanism which is associated with a separate cylinder actuator and which opens when the cylinder is in a retracted position and is closed to form the channel and gather material when the cylinder is in its extended position. Evans in U.S. Pat. No. 4,766,713 also discloses a gate mechanism which pivots in response to cylinder actuation. Seelly et al. in U.S. Pat. No. 4,993,135 disclose a gate mechanism which is manually actuated.

The referenced devices work well and provide generally an adequate mechanism for gathering casing material, defining a clip channel for receipt of a U-shaped metal clip, and for applying a clip about the gathered material. There has remained, however, the need for an improved gate construction associated with a clip attachment apparatus. The present invention comprises such an improvement.

SUMMARY OF THE INVENTION

In the principal aspect, the present invention is an improvement in a clip attachment apparatus of type which includes a support frame, a clip channel for receipt of a U-shaped metal clip, a window for feeding the clip into the channel and a die for forming the clip about gathered material at one end of the channel. The improvement specifically relates to the construction of the gate members which are designed to define the sides of the channel at one end of the channel. In a preferred embodiment there are two gate members, both of which are pivotally attached to the frame. One of the gate members defines a portion of the channel and supports the die. The other gate member defines the opposite side of the channel and may support a cutting knife which is used to cut or sever the gathered material following attachment of clips thereto.

An important feature and improvement of the invention is the means for driving the gates about their pivot axis to thereby open and close the channels. This means comprises a yoke which is linked to the gate. The yoke comprises an arm pivotally attached at one end to the gate and cooperative with a circular driven cam at the opposite end. The yoke thus defines a circular follower of the driven cam and the circular cam rides within the circular opening in the yoke. The circular cam is eccentrically mounted so that upon rotation thereof by means of an actuator, the yoke and thus the gate is extended or retracted.

As an important feature of this construction, the rotational velocity imparted to the gate in the fully opened and fully closed position substantially approaches zero velocity. This results because of the choice of the configuration of the eccentric cam and yoke and the physical arrangement of the rotation axis of the cam relative to the yoke. In the preferred embodiment opposing gate members are both driven by a similar mechanism. The gate members thus may moved into and out of position to form a clip channel with a die at the lower end thereof.

Thus, it is an object of the invention to provide an improved clip attachment apparatus.

It is a further object of the invention to provide an improved clip apparatus of the type wherein a clip channel is defined, at least in part, by a gate which is pivotal into and out of position to form the channel and which thereby defines a throat or opening for insertion of material in the pathway of the channel.

It is a further object of the invention to provide an improved clip attachment apparatus wherein a gate for forming the clip channel is provided and further wherein the rotational velocity of the gate as it pivots about its attachment to a frame approaches zero velocity in the fully opened and fully closed positions of the gate.

Yet another object of the invention is to provide an improved clip attachment apparatus which is efficient, reliable economical to manufacture and easy to repair.

These and other objects, advantages, and features of the invention will be set forth in the detailed description which follows.

BRIEF DESCRIPTION OF THE DRAWING

In the detailed description which follows reference will be made be made to the drawing comprised of the following figures:

FIG. 4 is a front view of the gates assembly which is incorporated in the clip attachment apparatus of the invention;

FIG. 5A is a front plan view of the die gate assembly associated with the gates assembly of FIG. 4;

FIG. 5B is an end view of the die gate assembly of FIG. 5A;

FIG. 6A is an exploded view of the knife gate assembly of FIG. 4;

FIG. 6B is a side view of FIG. 6A;

FIG. 7 is a plan view of the eccentric cooperative with the yoke assembly of FIG. 7A;

FIG. 7A is a front plan exploded view of the gate yoke assembly;

FIG. 7B is a side view of FIG. 7A;

FIG. 8 is a front elevation of the knife cylinder assembly which is incorporated in the knife gate assembly of FIG. 6A;

FIG. 10 is an outlet side view of the gate rotary actuators.

DESCRIPTION OF THE PREFERRED EMBODIMENT

Figure 1:
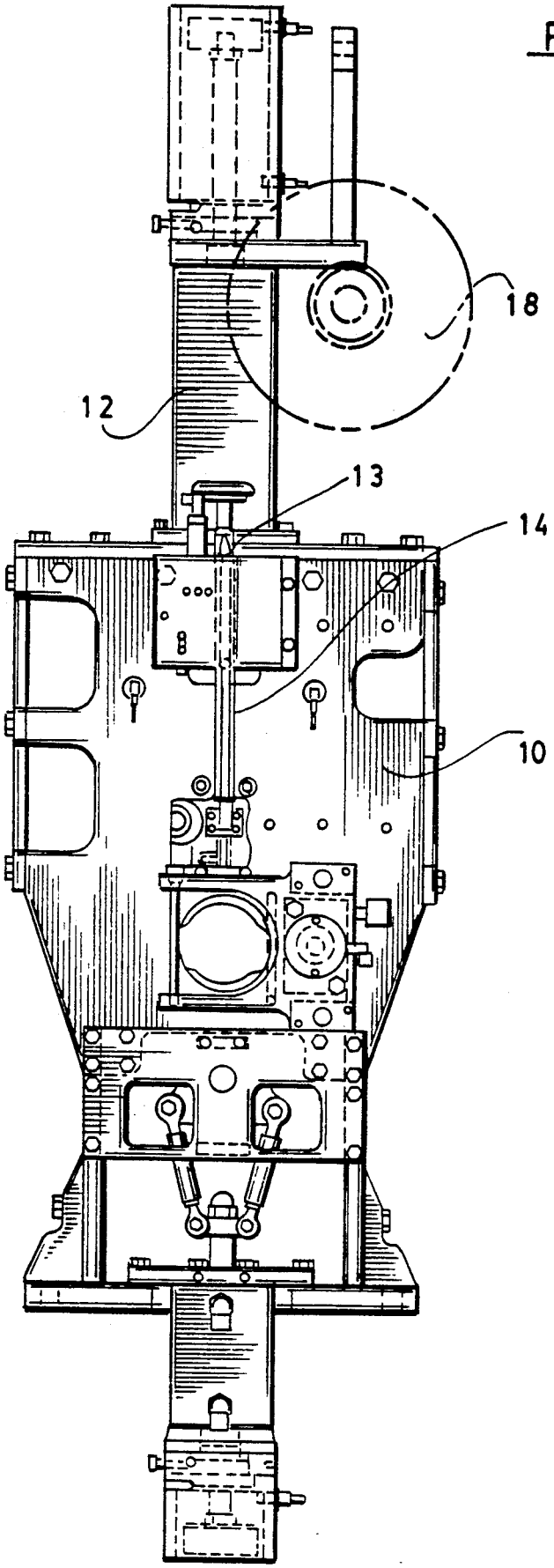
FIG. 1 is an inlet side view of the improved clip attachment apparatus of the invention depicting the apparatus from the inlet side for casing material which may be inserted thereto.
Figure 2:
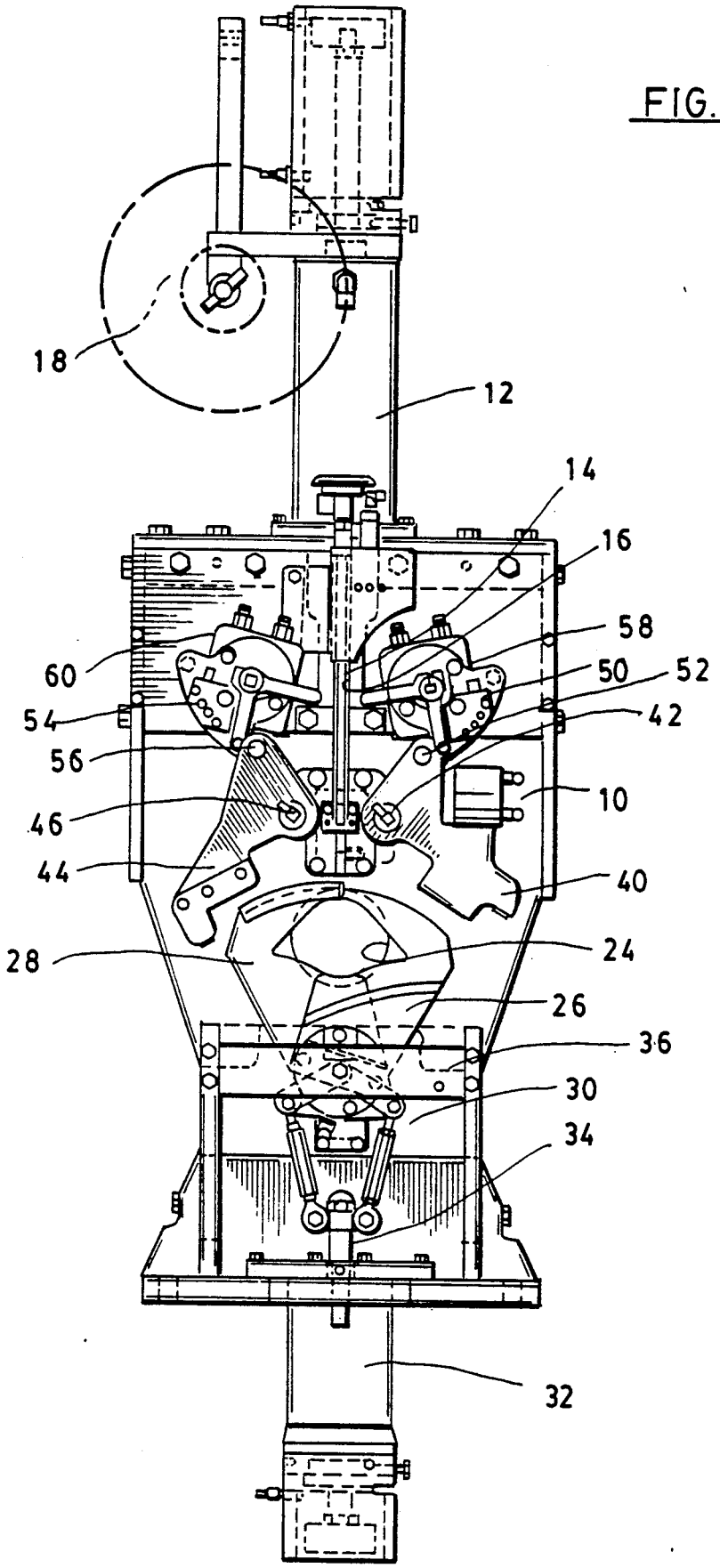
FIG. 2 is an outlet side view of the clip attachment apparatus in FIG. 1.
Figure 3:
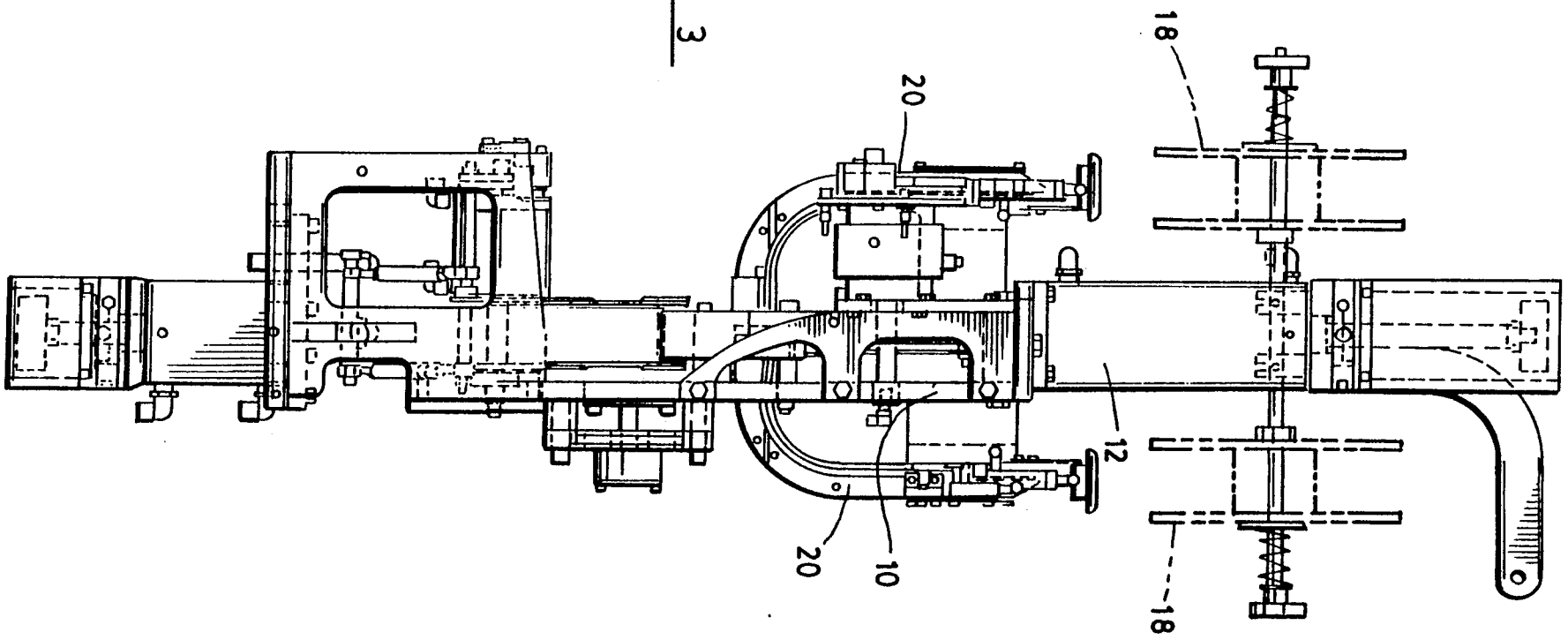
FIG. 3 is a front view of the clip attachment apparatus in FIG. 1.

Referring first to FIGS. 1 through 3, there is disclosed a clipper apparatus which incorporates the invention. The apparatus includes a frame 10 which supports a punch cylinder 12 that operates a reciprocal rod to drive a punch 14 in a channel 16 running vertically through or attached to the frame 10. U-shaped metal clips are fed from a clip spool 18 onto a clip rail assembly 20 and into a window 65 to the channel 16. In the clipper or clip attachment apparatus depicted, the frame 10 supports two clip spools 18 and two clip assemblies 20 on opposite of the frame 10 so that two clips are simultaneously fed into two parallel channels 16 within or supported by the frame 10. The channels 16 are spaced from one another so that gathered material may be placed in the clip attachment apparatus, and two clips, which are spaced from one another, simultaneously are attached to the gathered material. A knife is then utilized to sever the gathered material between the two attached clips. The described device is known as a double clipper.

The clip attachment apparatus of the invention further includes an opening 24 in the frame 10 which receives casing materials filled with a meat product, for example. Positioned on opposite sides of the opening 24 are voider plates 26 and 28 which are driven by a linkage 30 responsive to actuation of a cylinder 32 which operates a rod 34. The voider plates 26, 28 are driven toward one another after a casing product is positioned in the opening 24 to thereby effect gathering of the material so that clips may be formed about the material. Thus, referring to FIG. 2 the voider or gathering plates 26 and 28 will simultaneously be rotated about an axis 36 toward one another to gather the casing material positioned in the opening 24.

Substantially simultaneously the gate assembly is operated to form a clip channel 16. In this instance a pair of parallel clip channels 16 are depicted as being formed by the gate assembly for receiving clips from the clip rail assembly 20. More specifically, a knife gate or first gate 40 pivots about an axis of pivot pin 42 to form one side of the channels 16. A die gate or second gate 44 pivots about an axis of pivot pin 46 to form the opposite side of the channel 16 as well as support a die 66 which co-acts with the clips driven down the channels 16 by operation of the punch cylinder 12. The gates 40 and 44 thus are pivotal between the position shown in FIG. 2 and a closed position wherein the gates are pivoted toward one another to define parallel sides for the channel 16. Note, in the embodiment shown, the gates 40 and 44 fit in between the gathering plates 26 and 28. Thus, as the gates 40 and 44 approach one another to define the lower end of the clip channel 16 they further compress gathered material in the opening 24 to its final configuration so that U-shaped, metal clips may fit over the gathered material.

The die gate 44 also supports a die 66 at the lower end of the channels 16 for cooperation with the clips. The knife gate 40 includes a knife assembly which will be described in greater detail for severing the gathered material between the attached clips.

The improvement of the present invention relates specifically to the construction of the gates 40 and 44 as well the associated actuators which drive the gates 40 and 44 between the open position illustrated in FIG. 2 and the closed position. Thus, the knife gate 40 is driven by a yoke 50 which is pivotally attached to the gate 40 at pivot connection 52. The die gate 44 is driven by a yoke 54 which is pivotally connected to the gate 44 at the pivot connection 56. Yokes 50 and 54 are driven by eccentric actuators (to be described below) to effect opening and closing the gates 40 and 44. The actuators generally depicted at 58 and 60 operate sequentially (prior to downward actuation of the punch cylinder assembly 12) to close gates 40 and 44 so that the clip channels 16 form and so that a die 66 will be in position for cooperation with the clips prior to actuation to the punch cylinder assemble 12. It is to be noted that the actuators 58 and 60 are supported by the frame 10.

The remaining FIGS. 4 through 10 illustrate in greater detail the construction of the gates assembly. The gates assembly includes a gate block mounting assembly 62 which is attached to the main frame 10 by shoulder bolts 64. The gate block 62 includes parallel clip channels 16 for receipt of the punch 14 and in this instance a pair of parallel channels 16. The gate block 62 also includes windows, such as window 65, defined on opposite sides thereof for receipt of a U-shaped metal clip in each channel 16. Clips entering the windows 65 may be driven down the channel 16 by a punch 14.

The die gate 44 is supported by a pivot pin 46 which cooperates with gate block 62 to permit pivotal motion of the die gate 44 about the axis defined by the pivot pin 46. In similar fashion the knife gate 40 is attached to the block 62 and pivotal thereon by means of the pivot pin 42.

A die 66 is supported in the die gate 44 so that when the die gate 44 is pivoted to the closed position, the die 66 will be positioned at the bottom the channels 16 for the clips. The die gate 44 also includes portions of channels specified as channel runs 68, again to complete the clip channel 16 for guiding a clip into appropriate cooperation with the die 66. The knife gate 50 includes a channel run 70 analogous to the channel 68 of the die gate 44. The knife gate 40 also includes a pad 72 cooperative with pad 74 defined on the die gate 44. The pads 72 and 74 ensure proper spacing and alignment of the die gate 44 and knife gate 40 when the gates 40, 44 are pivoted to their closed, channel forming positions.

The knife gate 40 includes a arm or lobe 76 which is connected by means of a pivot pin 52 to the yoke 50. In similar fashion the die gate 44 includes a lobe 78 connected by pivot pin 56 to yoke 54. Each yoke 50 and 54 includes on internal follower surfaces 80 and 82 respectively, which is circular in shape. The circular follower surfaces 80 and 82 cooperate with circular eccentrics 84 and 86 respectively which are mounted within the yokes 50 and 54. FIGS. 7, 7A and 7B illustrate in greater detail this assembly.

Each gate eccentric 84 and 86 is driven by a drive shaft or rod 88 and 90 respectively which rotates about the axis of the rod 88 and 90 to thereby cause the eccentrics 84 and 86 to spin about the axis of the rod 88 and 90 and impart linear motion to the yokes 50 and 54. This, in turn, pivots the die gate 44 and knife gate 40 moving those gates between the open and closed positions. The figures disclose the gates 40, 44 in the open position. Note, because of the configuration of the eccentrics 84 and 86, the velocity of the gates 40 and 44 is at a minimum when the gates 40, 44 are fully open and when the gates 40, 44 are fully closed. The velocity approaches a maximum upon 90 degree rotation of the eccentrics 84 and 86 or about when they are one-half closed. This results because the drive shafts 88 and 90 are positioned substantially in the lower mid line of the eccentrics 84, 86 when the gates 40, 44 are in the fully open position as illustrated in FIG. 4.

Referring further to FIGS. 6A and 6B, there is disclosed the knife gate 40. The knife gate 40 includes a mounting block 91 which receives and supports a knife cylinder 92 that operates a knife 94 driven by a control rod 96 projecting from cylinder 92 as previously described. Thus, upon application of clips about the gathered material by operation of the punches 14, the knife cylinder 92 is actuated to cause the knife 94 to sever the gathered material between the clips.

Referring to FIGS. 7A and 7B there is illustrated the yoke assembly which is comprised of the yoke 50, (54) and the eccentric 84 (86).

Figure 9:
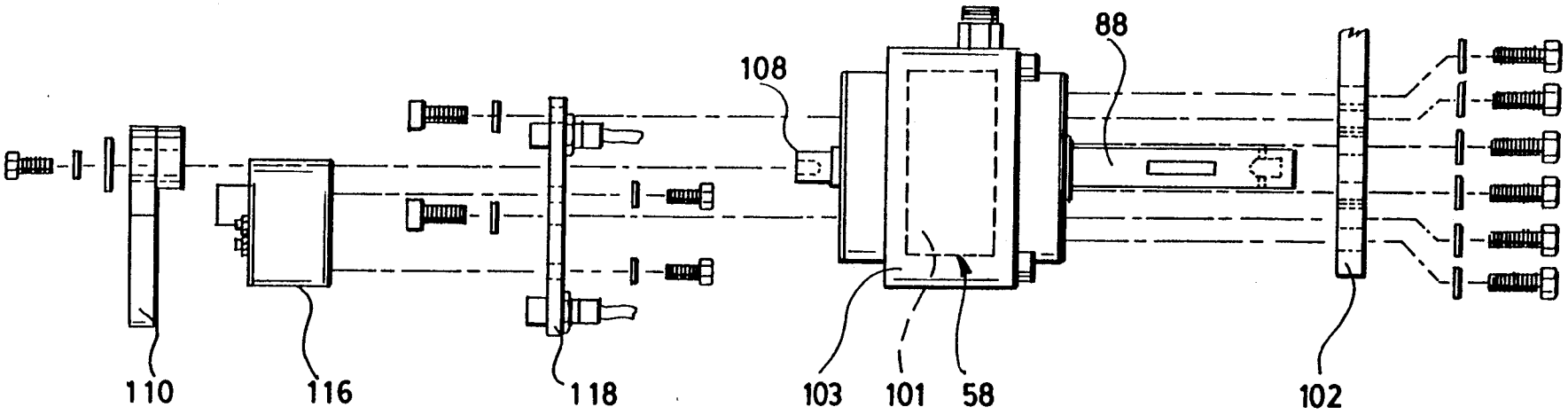
FIG. 9 is an exploded plan view of the gate rotary actuator assembly which is used to drive the gate yoke assembly of FIG. 7A and 7B.
Figure 11:
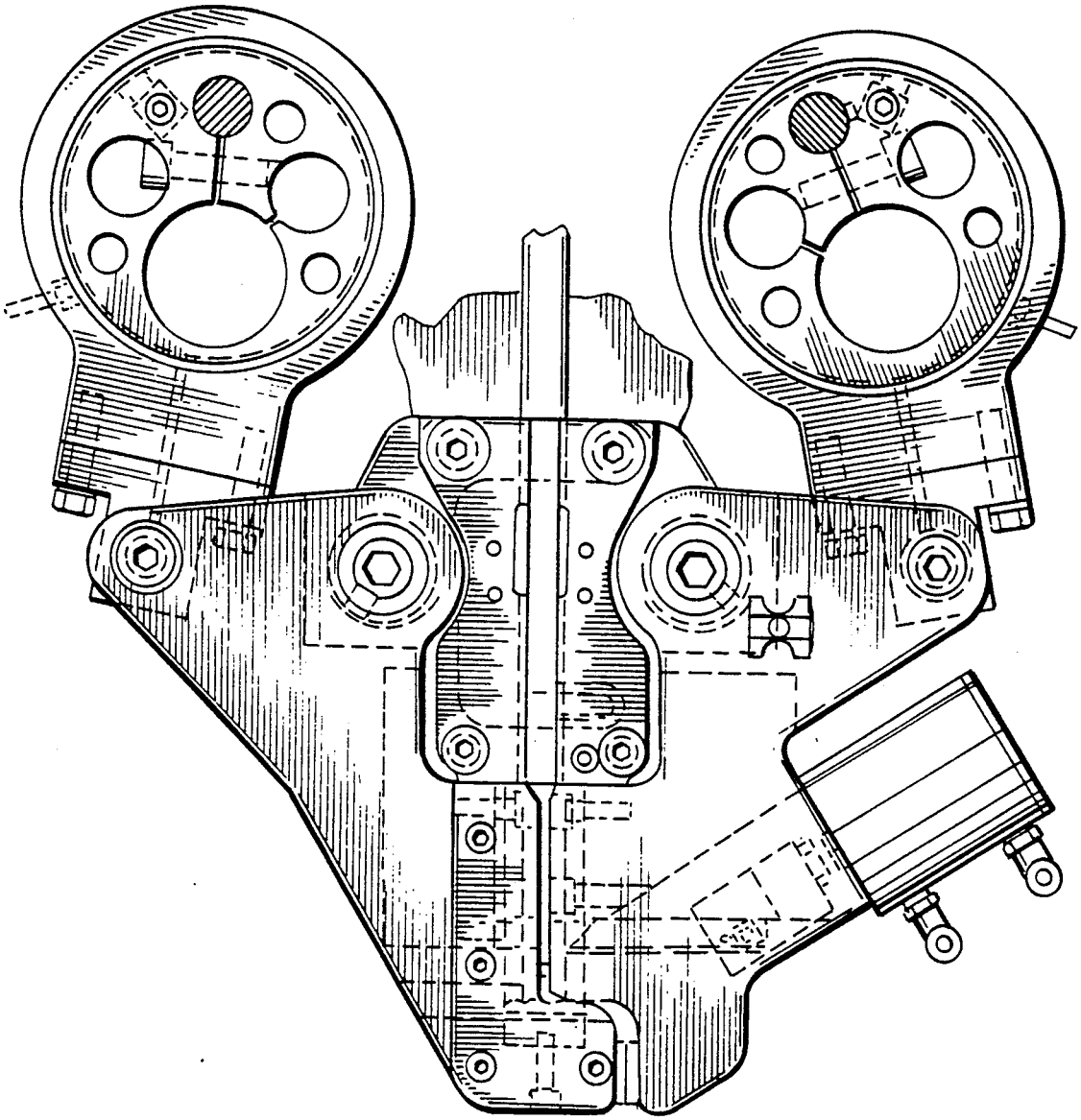
FIG. 11 is a front view of the gates assembly similar to FIG. 4 but in the gates closed position.

FIG. 9 illustrates the construction of an actuator 58 which is comprised of rotary, fluid drive motor 101 in a housing 103 which is supported on a support plate 102 that is attached to the frame 10. The rotary actuator 100 includes the rotary motor 101 having an output shaft 88 which fits through a passage in the plate 102 and cooperates with the eccentric 84 as previously described. This actuation of the rotary actuator 58 causes rotation of the shaft 88 and thus actuation of one the gates 40. Gate 44 is driven in similar fashion. Thus, an actuator 58 of the type shown in FIG. 9 is utilized for each of the gates 40 and 44.

The shaft 88 extends in the opposite direction through the actuator 100 as pin 108. The pin 108 is keyed to and drives a rotary actuator stop member 110. The rotary actuator stop member 110 has arms 112 and 114 as shown in FIG. 10. A fixed cushion block 116 is attached to a plate 118 which, in turn, is attached to the actuator 100. The pin 108 rotates the stop member about the axis of the pin 108. Stop arms 112 or 114 may thus engage against sides of the block 116 to limit travel of the pin 88 about its axis. This effectively controls the limits of rotation of eccentric 84 which causes movement of the gate 40. By adjusting the position and spacing of the arms 112 and 114 it is thus possible to control the amount of the rotation of the pin 108 and thus the operation of the opening and closing of the gate 40. Gate 44 is similarly controled.

Important features of the invention thus comprise the yoke and eccentric mechanism, and the actuator which is provided to drive the eccentric. The construction of the gates 40 and 44 is also an important feature in combination with the other elements previously described. However, various changes and modifications may be made to the invention without departing from the true spirit and scope thereof. For example, the clip apparatus may utilize a single gate rather than a pair of opposed gates. The clip apparatus may use a gate having a single clip channel therein. Other modifications and changes may also be made to the subject matter of the invention. The invention is therefore to be limited only by the following claims and their equivalents.

What is claimed is:

1. In clip attachment apparatus of the type including a support frame, a clip channel for receipt of a U-shaped metal clip, a window for feeding a clip into the channel, a die for forming the clip about gathered material, said die positioned at the end of the channel, a punch for driving a clip in the channel against the die, and at least one gate member pivotally attached to the frame, said gate member forming a part of the channel when pivoted to a closed position and defining a throat for receipt of gathered material when pivoted to an open position, the improvement comprising, in combination:

gate driving means for reciprocating the gate between the open and closed positions, said gate driving means including a generally cylindrical follower yoke linked to the gate;

a generally circular cam eccentric cooperatively engaging the yoke and defining a cam for driving the yoke as a follower, said eccentric mounted for rotation on the frame; and means for rotating the eccentric to drive the yoke and gate from a fully open position to a fully closed position, said eccentric and yoke cooperative to impart substantially no rotational velocity to the gate in the fully open and fully closed positions.

2. The improvement of claim 1 comprising first and second gates, one of waid gates supporting the die and one side of the channel, the other gate supporting the other side of the channel.

3. The improvement of claim 2 wherein the other gate includes a cutting knife which may be actuated to sever material gathered by the gates.

4. In clip attachment apparatus of the type including a support frame, a clip channel for receipt of a U-shaped metal clip, a window for feeding a clip into the channel, a die for forming the clip about gathered material, said die positioned at the end of the channel, a punch for driving a clip in the channel against the die, and at least one gate member pivotally attached to the frame, said gate member forming a part of the channel when pivoted to a closed position and defining a throat for receipt of gathered material when pivoted to an open position, the improvement comprising, in combination:

gate driving means for reciprocating the gate between the open and closed positions, said gate driving means including a follower yoke linked to the gate;

an eccentric cooperatively engaging the yoke and defining a cam for driving the yoke as a follower, said eccentric mounted for rotation on the frame;

means for rotating the eccentric to drive the yoke and gate from a fully open position to a fully closed position, said eccentric and yoke cooperative to impart substantially no rotational velocity to the gate in the fully open and fully closed positions; and stops to limit the relative rotation of the yoke and eccentric.

5. The improvement of claim 1 including stops to limit the relative rotation of the yoke and eccentric.

6. The improvement of claim 1 including a rotary actuator for the eccentric.

7. The improvement of claim 6 including means for driving the punch and including independent means for driving the actuator.

8. The improvement of claim 4 wherein the yoke comprises a generally cylindrical follower and the eccentric comprises a generally circular cam rotatable about an eccentric rotation axis.

9. The improvement of claim 4 wherein the eccentric is mounted on a shaft, and further including stop arms fixed to the shaft, and a stop block on the frame cooperative with the stop arms to limit rotational movement of the shaft.

* * * * *